US010618782B2

(12) United States Patent
Wang

(10) Patent No.: US 10,618,782 B2
(45) Date of Patent: Apr. 14, 2020

(54) ELECTRIC WINCH

(71) Applicant: INTRADIN (SHANGHAI) MACHINERY CO., LTD., Shanghai (CN)

(72) Inventor: Junliang Wang, Shanghai (CN)

(73) Assignee: INTRADIN(SHANGHAI) MACHINERY CO., LTD, Shanghai (CN)

( * ) Notice: Subject to any disclaimer, the term of this patent is extended or adjusted under 35 U.S.C. 154(b) by 0 days.

(21) Appl. No.: 16/236,252

(22) Filed: Dec. 28, 2018

(65) Prior Publication Data

US 2019/0194001 A1 Jun. 27, 2019

Related U.S. Application Data

(63) Continuation of application No. PCT/CN2018/072407, filed on Jan. 12, 2018.

(30) Foreign Application Priority Data

Dec. 21, 2017 (CN) ..... 2017 1 1390503

(51) Int. Cl.

| | |
|---|---|
| ***B66D 1/12*** | (2006.01) |
| ***B66D 1/40*** | (2006.01) |
| ***B66D 1/14*** | (2006.01) |
| ***B66D 1/22*** | (2006.01) |

(52) U.S. Cl.

CPC ..... *B66D 1/12* (2013.01); *B66D 1/14* (2013.01); *B66D 1/22* (2013.01); *B66D 1/40* (2013.01)

(58) Field of Classification Search

CPC ... B66D 1/12; B66D 1/14; B66D 1/40; B66D 1/22; B66D 1/7484; B66D 3/22

See application file for complete search history.

(56) References Cited

U.S. PATENT DOCUMENTS

| | | | | | |
|---|---|---|---|---|---|
| 1,946,145 | A * | 2/1934 | Johnson | B66D 1/48 | 254/344 |
| 4,227,680 | A * | 10/1980 | Hrescak | B66D 1/22 | 254/344 |
| 4,440,041 | A * | 4/1984 | Bendtsen | B66D 1/22 | 192/3.57 |
| 5,507,471 | A * | 4/1996 | Mercurio | B66C 1/18 | 254/134.3 R |

(Continued)

FOREIGN PATENT DOCUMENTS

| | | | | |
|---|---|---|---|---|
| CN | 2018-652908 | * | 5/2018 | |
| GB | 704344 A | * | 2/1954 | B65G 23/08 |

*Primary Examiner* — Michael E Gallion

(74) *Attorney, Agent, or Firm* — Wayne & Ken, LLC; Tony Hom

(57) ABSTRACT

An electric winch includes a winch body; a drive motor configured to drive the winch body, the drive motor being a brushless motor; a lithium battery configured to power the drive motor; and a motor controller electrically connected between the lithium battery and the drive motor and configured to control the drive motor. The winch body includes a winch support on which the drive motor is fixedly mounted; a gearbox connected to the drive motor and configured to receive a driving force of the drive motor; and a winch drum connected to the gearbox and driven by the gearbox to rotate. The electric winch of the present invention has the advantages of small volume, long service life, low noise and convenience for carrying.

3 Claims, 2 Drawing Sheets

(56) References Cited

U.S. PATENT DOCUMENTS

| | | | | |
|---|---|---|---|---|
| 6,182,592 | B1 * | 2/2001 | Molz | B63B 21/16 114/230.2 |
| 9,598,269 | B2 * | 3/2017 | Hall | G01G 19/14 |
| 9,988,251 | B2 * | 6/2018 | Hall | B66D 1/38 |
| 10,189,687 | B2 * | 1/2019 | Hiekata | B66D 1/12 |
| 2009/0309082 | A1 * | 12/2009 | Webb | B66D 1/12 254/340 |
| 2011/0180770 | A1 * | 7/2011 | Karambelas | B66D 1/12 254/344 |
| 2011/0303886 | A1 * | 12/2011 | Cryer | B66D 1/22 254/340 |
| 2016/0159625 | A1 * | 6/2016 | Janik | B66D 1/485 701/21 |
| 2019/0016571 | A1 * | 1/2019 | Thirunarayana | B66D 1/12 |

* cited by examiner

ELECTRIC WINCH

CROSS-REFERENCE TO RELATED APPLICATIONS

This application is a continuation of International Patent Application No. PCT/CN2018/072407, filed on Jan. 12, 2018, which claims the benefit of priority from Chinese Application No. 201711390503.4, filed on Dec. 21, 2017. The contents of the aforementioned applications, including any intervening amendments thereto, are incorporated herein by reference in its entirety.

TECHNICAL FIELD

The present invention relates to outdoor tools, and more particularly to an electric winch.

BACKGROUND

Electric winches play great roles in outdoor work such as traction, rescue, lifting, dragging. Currently, some electric winches on the market are driven by power system contained in vehicles, and others are driven by brush motors, which however are large in size and difficult to carry. Electric winches are often installed in relatively small spaces, so the application scenario of the electric winches of larger sizes are greatly limited. At the same time, the existing electric winches generally have problems of loud noise and short service life during use.

SUMMARY

To solve the above problems, the present invention provides an electric winch with the advantages of a small volume, long service life and convenience for carrying.

The electric winch includes a winch body; a drive motor configured to drive the winch body, the drive motor being a brushless motor; a lithium battery configured to power the drive motor; and a motor controller electrically connected between the lithium battery and the drive motor and configured to control the drive motor. The winch body includes a winch support on which the drive motor is fixedly mounted; a gearbox connected to the drive motor and configured to receive a driving force of the drive motor; and a winch drum connected to the gearbox and driven by the gearbox to rotate.

Preferably, the motor controller has a motor controller housing. The drive motor has a motor housing in communication with the motor controller housing.

Preferably, the motor housing is provided with an air outlet, and the motor controller housing is provided with an air inlet. The drive motor is internally provided with a motor fan blade which is rotatable when the drive motor operates.

Preferably, the drive motor is fixedly mounted at one end of the winch support, and the gearbox is arranged at the other end of the winch support. The winch body is further provided with a transmission shaft for connecting the drive motor and the gearbox.

Preferably, the drive motor has a drive shaft, and the drive shaft is connected to the transmission shaft via a flexible connector.

Preferably, the winch drum is sheathed on the transmission shaft to rotate around the transmission shaft.

Preferably, the winch drum is supported on the transmission shaft by means of a support structure. The support structure is rotatable around the transmission shaft.

Preferably, the support structure includes a support plate perpendicular to the transmission shaft and a support sleeve sheathed on the transmission shaft and connected to the support plate.

Preferably, an input end of the gearbox is connected to the drive motor, and an output end of the gearbox is connected to the winch drum. The drive motor and the winch drum are respectively arranged on both sides of the gearbox.

Preferably, the winch drum has a drum shaft. The drum shaft is connected to the gearbox and provided with a damping spring.

In the electric winch according to the present invention, an independent lithium battery is employed as a driving power source and the motor controller is used to control outputs, thereby driving the brushless motor to drive the winch drum to rotate. Combination of lithium battery and brushless motor has the advantages of small volume, long service life, low noise and convenience for carrying.

The further aspects and advantages of the present invention will be described below and become obvious or understandable through the following description or embodiments of the present invention.

DETAILED DESCRIPTION OF EMBODIMENTS

The present invention will be further described in conjunction with the drawings and specific embodiments. It should be understood that the specific embodiments are only illustrative of, but not intended to limit the present invention.

Figure 1:
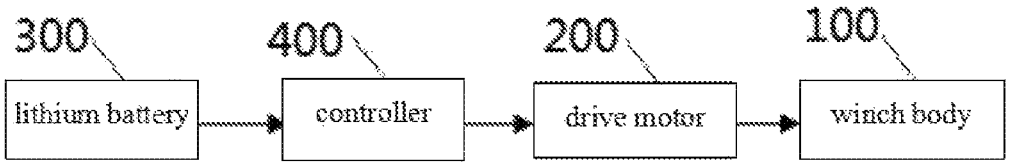
FIG. 1 is a schematic diagram of an electric winch according to an embodiment of the present invention.
Figure 2:
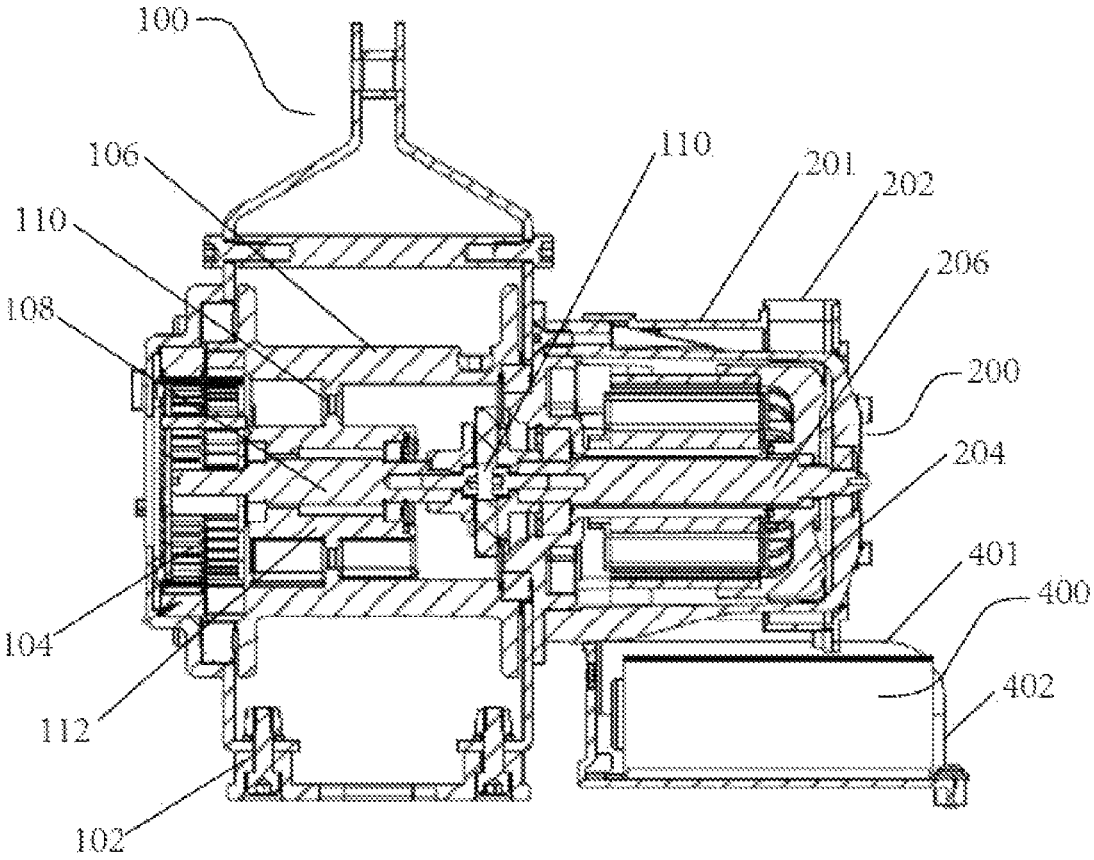
FIG. 2 is a sectional view of the electric winch according to the embodiment of the present invention.
Figure 3:
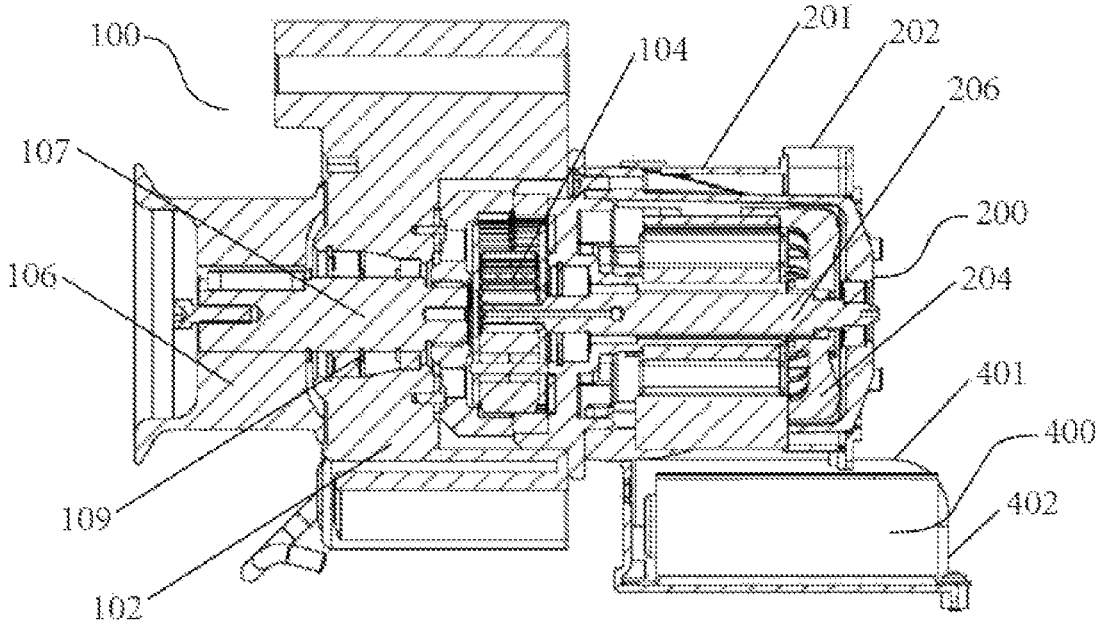
FIG. 3 is a sectional view of an electric winch according to another embodiment of the present invention.

As shown in FIGS. 1-3, the present invention provides an electric winch including a winch body 100, a drive motor 200 configured to drive the winch body 100, a lithium battery 300 configured to power the drive motor 200, and a motor controller 400 electrically connected between the lithium battery 300 and the drive motor 200 configured to control the drive motor 200. The drive motor is a brushless motor without electric brush and related interfaces. Therefore, the electric winch provided by the present invention has a simpler structure, lower noise and longer service life.

As shown in FIGS. 2 and 3, the winch body 100 includes a winch support 102, a gearbox 104 and a winch drum 106. The drive motor 200 is fixedly mounted on the winch support 102. The gearbox 104 is connected to the drive motor 200 to receive the driving force from the drive motor 200. The winch drum 106 is connected to the gearbox 104 and then driven by the gearbox 104 to rotate.

The working principle of the electric winch is as follows: when the drive motor 200 start to rotate under the control of the motor controller 400, the gearbox 104 is driven by the drive motor 200 to rotate, thus driving the winch drum 106 to rotate upon torque amplification to wind up or wind out the winch cable (e.g., steel cable, winding rope, etc.).

Generally, the power of the drive motor 200 in the electric winch is generally small, only a few horsepower, which is insufficient for traction, lifting, dragging, etc. Therefore, Therefore, it is necessary to amplify the torque through the gearbox 104 when the electric winch operates. It can be understood that the specific structure of the gearbox 104 is not limited herein, and it can be of various structures commonly used in the art. For example, in some embodiments, the gearbox 104 is a planetary gear mechanism having a small volume, thereby further reducing the volume of the electric winch. Moreover, the planetary gear mechanism has a relatively large reduction ratio and a longer service life.

As shown in FIGS. 2-3, in some embodiments, the motor controller 400 has a motor controller housing 401. The drive motor 200 has a motor housing 201. The motor controller housing 401 is in communication with the motor housing 201. It is understood that "in communication with" used herein means that an internal cavity of the motor controller housing 401 communicates with an internal cavity of the motor housing 201; that is, a cooling medium (such as air) is able to flow in the motor controller housing 401 and the motor housing 201. Then, through the arrangement of the motor controller 400 and the drive motor 200 that are in communication with each other, the heat dissipation space of the driving motor 200 and the motor controller 400 can be expanded, improving the heat dissipation effect.

Further, in some embodiments, as shown in FIGS. 2-3, the motor housing 201 is provided with an air outlet 202, and the motor controller housing 401 is provided with an air inlet 402. The drive motor 200 is internally provided with a motor fan blade 204. The motor fan blade 204 is rotatable when the drive motor 200 operates. In other words, when the electric winch works, the outside cold air is sucked into the motor controller housing 401 from the air inlet 402 through the rotation of the motor fan blade 204. After passing through the motor housing 201, the cold air is discharged from the air outlet 202 to take the heat away, dissipating heat from the drive motor 202 and the motor controller 400. That is, the air passage of the motor fan blade 204 passes through the motor controller 400 and then the drive motor 200, so that the heat dissipation of these two components can be accelerated, leading to a very good heat dissipation effect of the whole machine.

As shown in FIG. 2, in some embodiments, the drive motor 200 is fixedly mounted at one end (a right side of the winch support 102 shown in FIG. 2) of the winch support 102, and the gearbox 104 is arranged at the other end (a left side of the winch support 102 shown in FIG. 2) of the winch support 102. The winch body 100 is further provided with a transmission shaft 108 to connect the drive motor 200 and the gearbox 104. Therefore, when the drive motor 200 works, the driving force is transmitted to the gearbox 104 through the transmission shaft 108.

To further reduce vibration and noise, in an embodiment, a flexible connector 110 is provided between the drive motor 200 and the transmission shaft 108. The drive motor 200 has a drive shaft 206, and the drive shaft 206 is connected to the transmission shaft 108 through the flexible connector 110. It can be understood that the flexible connector 110 of the present invention is not limited, and it may be any of various flexible connectors known to those skilled in the art as long as it is suitable for the electric winch.

As shown in FIG. 2, in an embodiment, the winch drum 106 is sheathed on the transmission shaft 108 to rotate around the transmission shaft 108. It can be understood that the winch drum 106 is directly sheathed on the transmission shaft 108, or is sheathed on the transmission shaft 108 through a support structure. Thus, the drive motor 200, the gearbox 104 and the winch drum 106 are transversely arranged in alignment, leading to a more compact structure and a smaller volume of the electric winch. At the same time, the winch drum 106 is sheathed on the transmission shaft 108 and is provided between the gearbox 104 and the drive motor 200, which may further reduce the size of the electric winch in an axial direction to reduce the volume of the electric winch. It can be understood that in this embodiment, the left side of the winch drum 106 is connected to the gearbox 104. For example, the left side of the winch drum 106 is engaged with the gearbox 104 through a gear. The right side of the winch drum 106 is a free end. The winch drum 106 is driven by the gearbox 104 to rotate to wind up or wind out the winch cable (e.g., steel cable, winding rope, etc.).

As shown in FIG. 2, in this embodiment, the winch drum 106 is sheathed on the drive shaft 108 through a support structure, and the support structure rotates round the transmission shaft 108. The support structure includes a support plate 110 perpendicular to the drive shaft 108 and a support sleeve 112 sheathed on the drive shaft 108 and connected to the support plate 110. The support sleeve 112 can rotate around the transmission shaft 108. It can be understood that the support plate 110 may be composed of a plurality of support ribs uniformly distributed on the outer circumference of the support sleeve 112, or may be an annular support plate distributed on the outer circumference of the support sleeve 112.

In another embodiment, as shown in FIG. 3, the input end of the gearbox 104 (a right side of the gearbox 104 shown in FIG. 3) is connected to the drive motor 200, that is, the drive shaft 206 of the drive motor 200 is connected to the input end of the gearbox 104. The output end of the gearbox 104 (a left side of the gearbox 104 shown in FIG. 3) is connected to the winch drum 106. The drive motor 200 and the winch drum 106 are respectively arranged on both sides of the gearbox 104. Thus, the drive motor 200, the gearbox 104 and the winch drum 106 are transversely arranged in alignment, leading to a more compact structure and a smaller volume of the electric winch.

As shown in FIG. 3, the winch drum 106 has a drum shaft 107. The drum shaft 107 passes through the winch support 102 to connect to the output end of the gearbox 104. To further reduce vibration and noise between the winch drum 106 and the winch support 102, a damping spring 109 may be arranged between the drum shaft 107 and the winch support 102. As shown in FIG. 3, in this embodiment, the damping spring 109 is sheathed on the drum shaft 107. One end of the damping spring 109 abuts against or is connected to the winch drum 106, and the other end of the damping spring 109 abuts against or is connected to the winch support 102.

It is understood that the electric winch may be of other structures known to or commonly used by those skilled in the art, which will not be described in detail in the present invention. Similarly, the electric winch provided by the present invention may also includes other structures or components commonly used in the art. For example, the electric winch may further include a winch cable guide capable of guiding the winch cable (such as steel cable, winding rope, etc.) to the winch drum directly or at an angle.

In the electric winch according to the present invention, an independent lithium battery is employed as a driving power source and the motor controller is used to control outputs, thereby driving the brushless motor to drive the winch drum to rotate. Combination of lithium battery and brushless motor has the advantages of small volume, long service life, low noise and convenience for carrying.

Although the embodiments of the present invention have been described above, it can be understood by those skilled in the art that various variations, modifications and replacements may be made without departing from the spirit and scope of the present invention. The present invention is defined by the claims and equivalents thereof.

What is claimed is:

1. An electric winch, comprising:

a winch body;

a drive motor configured to drive the winch body, the drive motor being a brushless motor;

a lithium battery configured to power the drive motor; and a motor controller electrically connected between the lithium battery and the drive motor and configured to control the drive motor;

wherein the winch body comprises:

a winch support on which the drive motor is fixedly mounted;

a gearbox connected to the drive motor and configured to receive a driving force of the drive motor; and a winch drum connected to the gearbox and driven by the gearbox to rotate;

wherein, an input end of the gearbox is connected to the drive motor; an output end of the gearbox is connected to the winch drum; the drive motor and the winch drum are respectively arranged on both sides of the gearbox;

the winch drum has a drum shaft, the drum shaft being connected to the gearbox and provided with a damping spring; the damping spring is sheathed on the drum shaft one end of the damping spring abuts against or is connected to the winch drum, and the other end of the damping spring abuts against or is connected to the winch support.

2. The electric winch according to claim 1, wherein the motor controller has a motor controller housing; and the drive motor has a motor housing in communication with the motor controller housing.

3. The electric winch according to claim 2, wherein the motor housing is provided with an air outlet, and the motor controller housing is provided with an air inlet; and the drive motor is internally provided with a motor fan blade which is rotatable when the drive motor operates.

* * * * *